US011952229B2

(12) United States Patent
Matsuo

(10) Patent No.: US 11,952,229 B2
(45) Date of Patent: Apr. 9, 2024

(54) IMAGE FORMING APPARATUS

(71) Applicant: KYOCERA Document Solutions Inc., Osaka (JP)

(72) Inventor: Takeshi Matsuo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 190 days.

(21) Appl. No.: 17/753,846

(22) PCT Filed: Sep. 24, 2020

(86) PCT No.: PCT/JP2020/035934
§ 371 (c)(1),
(2) Date: Mar. 16, 2022

(87) PCT Pub. No.: WO2021/065647
PCT Pub. Date: Apr. 8, 2021

(65) Prior Publication Data

US 2023/0027853 A1 Jan. 26, 2023

(30) Foreign Application Priority Data

Sep. 30, 2019 (JP) ..... 2019-178679

(51) Int. Cl.
*B65H 29/60* (2006.01)
*B65H 31/24* (2006.01)
*B65H 33/14* (2006.01)

(52) U.S. Cl.
CPC ..... *B65H 29/60* (2013.01); *B65H 31/24* (2013.01); *B65H 33/14* (2013.01); *B65H 2801/06* (2013.01)

(58) Field of Classification Search
CPC ..... B65H 29/60; B65H 31/24; B65H 33/14; B65H 33/04
See application file for complete search history.

(56) References Cited

U.S. PATENT DOCUMENTS 8,840,106 B2 * 9/2014 Hasegawa ..... G03G 15/5075 271/213
9,238,565 B2 * 1/2016 Miyashita ..... B65H 33/00
2014/0159306 A1 6/2014 Nonaka

FOREIGN PATENT DOCUMENTS

JP 2010189148 A 9/2010
JP 2010202337 A 9/2010

OTHER PUBLICATIONS

European Patent Office, Extended European Search Report Issued in Application No. 20871782.7, dated Oct. 31, 2022, Germany, 8 pages.

* cited by examiner

*Primary Examiner* — Howard J Sanders
(74) *Attorney, Agent, or Firm* — Alleman Hall & Tuttle LLP

(57) ABSTRACT

A control device executes: either a first conveyance change control or a second conveyance change control; and a retraction control when an operation device receives an interruption operation during execution of a specified number stack control. In the first conveyance change control, a sheet conveyance device of a target unit is changed to a relay conveyance state, and the sheet conveyance device of another coupled unit that is present downstream of the target unit in a main conveyance direction is changed to a stack conveyance state. In the second conveyance change control, the sheet conveyance device of another coupled unit that is present upstream in the main conveyance direction is changed to the stack conveyance state. In the retraction control, a lift mechanism of the target unit is caused to execute a mount operation by which a stack tray is moved down to a mount position on a carriage portion.

5 Claims, 5 Drawing Sheets

IMAGE FORMING APPARATUS

TECHNICAL FIELD

The present invention relates to an image forming apparatus that includes a main body unit and a plurality of coupled units each of which includes a sheet stack carriage.

BACKGROUND ART

An image forming apparatus configured to print a large amount of prints may include a main body unit and a plurality of coupled units (see, for example, PTL 1). The plurality of coupled units are coupled with each other and are coupled with the main body unit.

The main body unit includes a print device and discharges prints to the coupled units. Each of the coupled units includes a housing and a sheet stack carriage stored in the housing, and the sheet stack carriage supports a stack tray on which the prints are stacked in such a way as to move up and down the stack tray.

The housing includes a door configured to open and close an opening of the housing. The sheet stack carriage is inserted into or drawn out from the housing via the opening of the housing.

When the print device performs a continuous printing on a large number of sheets, each of the coupled units executes, in turn, a process to stack a predetermined specified number of prints on the stack tray.

For example, in a case where the continuous printing is performed on 1000 sheets, each of two coupled units executes, in turn, a process to stack 500 prints on the stack tray.

The sheet stack carriage is moved to a position of a post-process in a state where a large number of prints are stacked thereon. In the post-process, a punching process, a book-binding process or the like is performed on the prints.

CITATION LIST

Patent Literature

[PTL 1] Japanese Patent Application Publication No. 2010-189148

SUMMARY OF THE INVENTION

Problems to be Solved by the Invention

Meanwhile, depending on the state of the post-process, the sheet stack carriage may be desired to be moved to the position of the post-process before the number of prints stacked on the stack tray reaches the specified number.

In the above-mentioned case, stopping the continuous printing is not favorable since it leads to a decrease in efficiency in producing the prints.

The present invention has been made in view of such conventional circumstances, and it is an object of the present invention to provide an image forming apparatus that is configured to, without stopping the continuous printing, move the sheet stack carriage while in the middle of stacking the specified number of sheets on the stack tray.

Solution to the Problems

An image forming apparatus according to an aspect of the present invention includes a main body unit, a plurality of coupled units, a control device, and an operation device. The main body unit includes a print device configured to execute a print process to form an image on a sheet, and discharges the sheet with the image formed thereon in a predetermined main conveyance direction. The plurality of coupled units are coupled with each other and are coupled with the main body unit at downstream of the main body unit in the main conveyance direction. The control device controls devices that are included in the main body unit and the plurality of coupled units. The operation device receives a user operation. Each of the plurality of coupled units includes a housing, a sheet stack carriage, a lift mechanism, and a sheet conveyance device. The housing has a main opening and a door that is configured to open and close the main opening. The sheet stack carriage includes: a carriage portion configured to be stored into and drawn out from the housing via the main opening; and a stack tray on which sheets can be stacked. The lift mechanism moves up and down the stack tray of the sheet stack carriage stored in the housing. The sheet conveyance device changes from one of a stack conveyance state and a relay conveyance state to the other, wherein in the stack conveyance state, the sheet conveyance device conveys the sheet discharged from the main body unit or another coupled unit that is coupled therewith at upstream in the main conveyance direction, to a stack conveyance path that is toward onto the stack tray, and in the relay conveyance state, the sheet conveyance device conveys the sheet to a relay conveyance path that is toward another coupled unit that is coupled therewith at downstream in the main conveyance direction. The control device executes a specified number stack control in which the sheet conveyance device of a target unit is held in the stack conveyance state and the sheet conveyance device of another coupled unit that is present upstream of the target unit in the main conveyance direction, is held in the relay conveyance state until a predetermined specified number of sheets are stacked on the stack tray of the target unit that is selected from the plurality of coupled units. The control device further executes an interruption stack control when the operation device receives a predetermined interruption operation during execution of the specified number stack control. The interruption stack control includes: either a first conveyance change control or a second conveyance change control; and a retraction control. In the first conveyance change control, the sheet conveyance device of the target unit is changed to the relay conveyance state, and the sheet conveyance device of another coupled unit that is present downstream of the target unit in the main conveyance direction is changed to the stack conveyance state. In the second conveyance change control, the sheet conveyance device of another coupled unit that is present upstream of the target unit in the main conveyance direction is changed to the stack conveyance state. In the retraction control, the lift mechanism of the target unit is caused to execute a mount operation by which the stack tray is moved down to a mount position on the carriage portion.

Advantageous Effects of the Invention

According to the present invention, it is possible to provide an image forming apparatus that is configured to, without stopping the continuous printing, move the sheet stack carriage while in the middle of stacking the specified number of sheets on the stack tray.

DESCRIPTION OF EMBODIMENTS

The following describes an embodiment of the present invention with reference to the accompanying drawings for the understanding of the invention. It should be noted that the following embodiment is an example of a specific embodiment of the present invention and should not limit the technical scope of the present invention.

[Configuration of Image Forming Apparatus 100]

Figure 1:
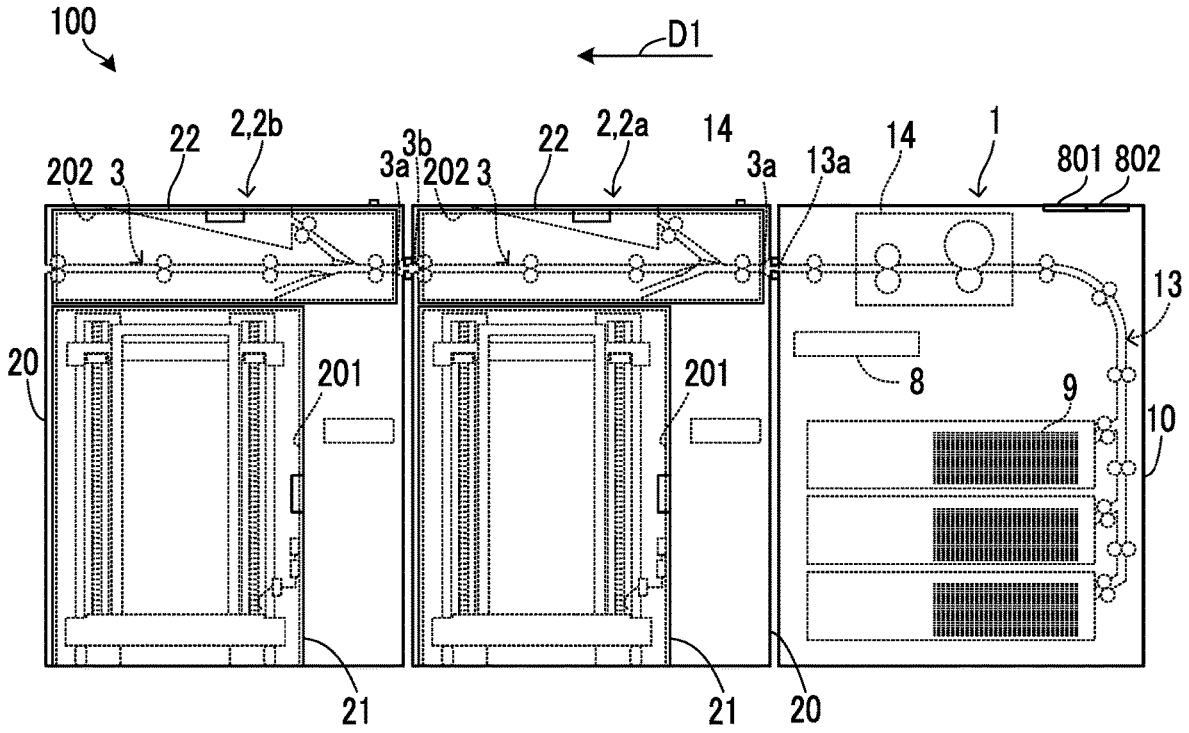
FIG. 1 is a diagram showing a configuration of an image forming apparatus according to an embodiment.

An image forming apparatus 100 according to an embodiment is used when large amounts of prints are printed. As shown in FIG. 1, the image forming apparatus 100 includes a main body unit 1, a plurality of coupled units 2, a main control device 8, a main operation device 801, and a display device 802.

The main body unit 1 includes a print device 14 configured to execute a print process to form an image on a sheet 9. The main body unit 1 discharges the sheet 9 with the image formed thereon in a predetermined main conveyance direction D1. It is noted that the sheet 9 with an image formed thereon is a print.

Figure 2:
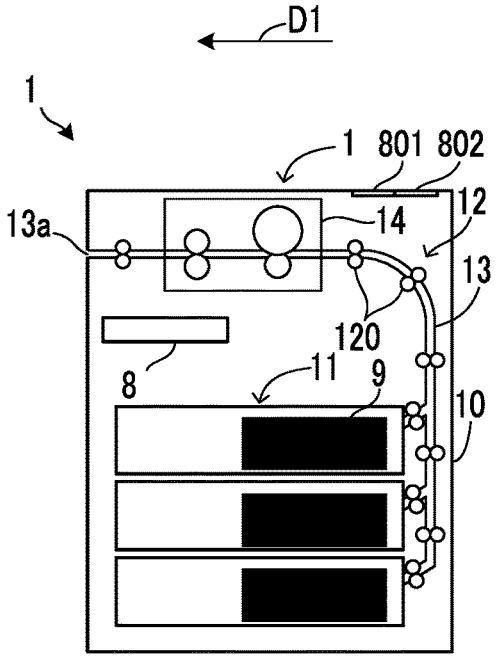
FIG. 2 is a diagram showing a configuration of a main body unit in the image forming apparatus according to the embodiment.

As shown in FIG. 2, the main body unit 1 includes a sheet supply portion 11, a primary sheet conveyance device 12, a primary conveyance path 13, and a print device 14 that are provided in a main body housing 10. The main control device 8 is also provided in the main body housing 10.

The main operation device 801 and the display device 802 are provided at an upper surface of the main body housing 10. The main operation device 801 is configured to receive user operations. For example, the main operation device 801 includes either or both of a touch panel and operation buttons.

The display device 802 is configured to display a menu screen or other information, the menu screen concerning operations to be performed on the main operation device 801.

The primary sheet conveyance device 12 conveys, one by one along the primary conveyance path 13, sheets 9 stored in the sheet supply portion 11. The print device 14 executes the print process on the sheet 9 conveyed along the primary conveyance path 13.

The primary sheet conveyance device 12 includes a plurality of pairs of conveyance rollers 120 that convey the sheet 9. The primary sheet conveyance device 12 discharges the sheet 9 with an image formed thereon in the main conveyance direction D1 from an outlet 13*a* of the primary conveyance path 13.

As shown in FIG. 1, the plurality of coupled units 2 are coupled with each other in the main conveyance direction D1, and are coupled with the main body unit 1 at downstream of the main body unit 1 in the main conveyance direction D1.

Figure 4:
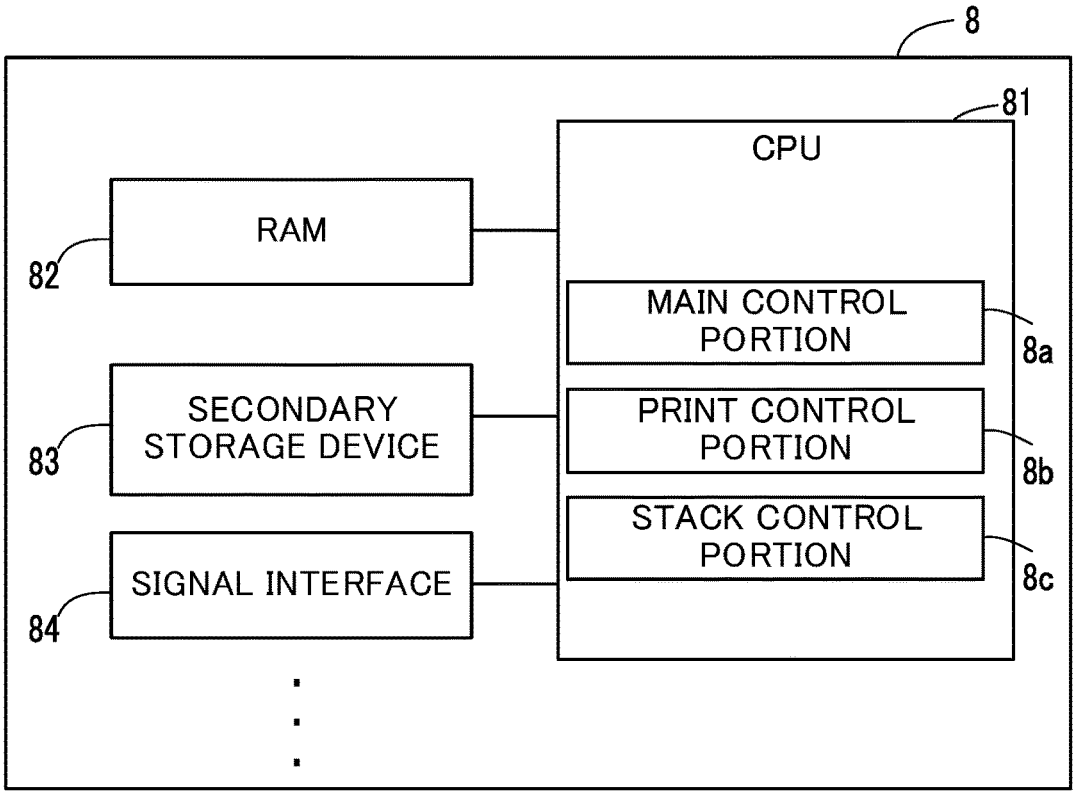
FIG. 4 is a block diagram showing a configuration of a control device in the image forming apparatus according to the embodiment.

The main control device 8 controls devices included in the main body unit 1 and the coupled units 2. As shown in FIG. 4, the main control device 8 includes a CPU (Central Processing Unit) 81 and peripheral devices such as a RAM (Random Access Memory) 82, a secondary storage device 83, and a signal interface 84.

The CPU 81 is a processor configured to perform various types of data processing and control by executing computer programs. The RAM 82 is a computer-readable volatile storage device. The RAM 82 primarily stores the computer programs executed by the CPU 81 and data that is output and referenced by the CPU 81 during execution of various types of processing.

The secondary storage device 83 is a computer-readable nonvolatile storage device. The secondary storage device 83 is configured to store and update the computer programs and various types of data. For example, either or both of a flash memory and a hard disk drive are adopted as the secondary storage device 83.

The signal interface 84 is configured to convert, to digital data, signals output from various types of sensors provided in the image forming apparatus 100, and transmit the digital data to the CPU 81. Furthermore, the signal interface 84 is configured to convert a control command output from the CPU 81 to a control signal and transmit the control signal to a control-target device.

Figure 3:
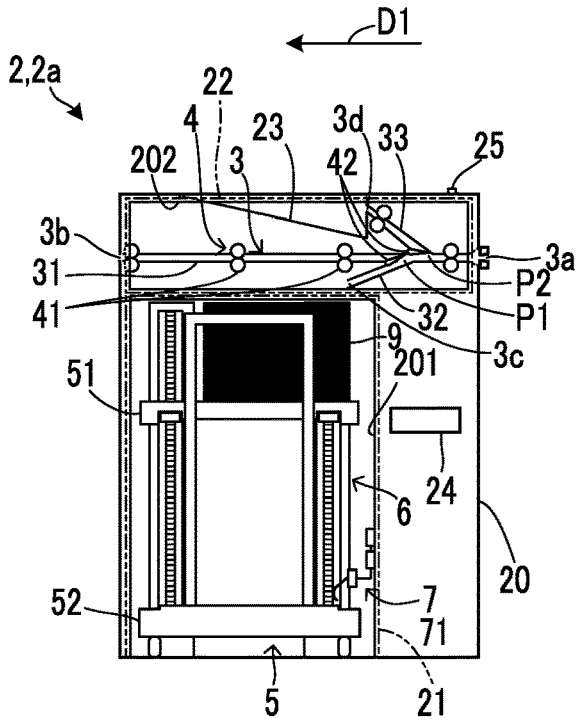
FIG. 3 is a diagram showing a configuration of a coupled unit in the image forming apparatus according to the embodiment.

As shown in FIG. 3, each of the coupled units 2 includes a coupled housing 20 and devices stored in the coupled housing 20. The devices stored in the coupled housing 20 include a secondary conveyance path 3, a secondary sheet conveyance device 4, a sheet stack carriage 5, and a lift mechanism 6. An auxiliary tray 23 is formed at an upper surface of the coupled housing 20.

A main opening 201 and a maintenance opening 202 are formed in the coupled housing 20. The coupled housing 20 includes a door 21 configured to open and close the main opening 201. Furthermore, the coupled housing 20 includes a maintenance cover 22 configured to open and close the maintenance opening 202.

The sheet stack carriage 5 includes a carriage portion 52 and a stack tray 51, wherein the carriage portion 52 is configured to be stored into and drawn out from the coupled housing 20 via the main opening 201, and sheets 9 can be stacked on the stack tray 51.

The secondary conveyance path 3 is conveyance path along which the sheet 9 is conveyed from the main body unit 1 into the coupled housing 20. An inlet 3*a* of the secondary conveyance path 3 is communicated with an upstream adjacent unit that is coupled upstream of its associated coupled unit 2 in the main conveyance direction D1. The upstream adjacent unit is the main body unit 1 or the other coupled unit 2.

The secondary conveyance path 3 includes a relay conveyance path 31, a stack conveyance path 32, and an auxiliary conveyance path 33, wherein the stack conveyance path 32 branches from the relay conveyance path 31 at a first branch portion P1, and the stack conveyance path 32 branches from the relay conveyance path 31 at a second branch portion P2.

The outlet of the relay conveyance path 31 is a relay discharge port 3*b* from which the sheet 9 is discharged toward the downstream in the main conveyance direction D1. The outlet of the stack conveyance path 32 is a stack discharge port 3*c* from which the sheet 9 is discharged toward the stack tray 51 of the sheet stack carriage 5. The outlet of the auxiliary conveyance path 33 is an auxiliary discharge port 3*d* from which the sheet 9 is discharged toward the auxiliary tray 23.

The inlet 3*a* of the secondary conveyance path 3 is communicated with: the outlet 13*a* of the primary conveyance path 13; or the relay discharge port 3*b* of the other coupled unit 2.

Each of the coupled units 2 functions as any one of: a terminal unit that collects, in the coupled unit 2 itself, the sheet 9 with an image formed thereon; a relay unit that conveys, in relay, the sheet 9 with an image formed thereon; and an inactive unit that is neither the terminal unit nor the relay unit.

In the present embodiment, a coupled unit 2 functioning as the terminal unit is configured to stack the sheet 9 on the stack tray 51 of the sheet stack carriage 5 or on the auxiliary tray 23.

In the following description, a coupled unit 2 in which the sheet 9 is stacked on the stack tray 51 of the sheet stack carriage 5 is referred to as a target unit 2*a*, and the other coupled unit 2 is referred to as a non-target unit 2*b* (see FIG. 1). The target unit 2*a* is an example of the terminal unit.

The secondary sheet conveyance device 4 conveys the sheet 9 along the secondary conveyance path 3. The secondary sheet conveyance device 4 includes a plurality of pairs of conveyance rollers 41 for conveying the sheet 9.

Furthermore, the secondary sheet conveyance device 4 further includes a movable guide mechanism 42. The movable guide mechanism 42 selectively guides the sheet 9 that has reached the first branch portion P1 or the second branch portion P2 to any one of the relay conveyance path 31, the stack conveyance path 32, and the auxiliary conveyance path 33.

In the following description, a state of the secondary sheet conveyance device 4 in which the movable guide mechanism 42 guides the sheet 9 to the stack conveyance path 32, is referred to as a stack conveyance state. In addition, a state of the secondary sheet conveyance device 4 in which the movable guide mechanism 42 guides the sheet 9 along the relay conveyance path 31, is referred to as a relay conveyance state.

That is, in the stack conveyance state, the secondary sheet conveyance device 4 conveys the sheet 9 discharged from the upstream adjacent unit, from the relay conveyance path 31 to the stack conveyance path 32 and conveys the sheet 9 onto the stack tray 51.

On the other hand, in the relay conveyance state, the secondary sheet conveyance device 4 conveys the sheet 9 discharged from the upstream adjacent unit, along the relay conveyance path 31 and discharges the sheet 9 toward a downstream adjacent unit. The downstream adjacent unit is the other coupled unit 2 that is coupled downstream of the coupled unit 2 in the main conveyance direction D1.

The secondary sheet conveyance device 4 is configured to change from one of the stack conveyance state and the relay conveyance state to the other.

The lift mechanism 6 is configured to move up and down the stack tray 51 of the sheet stack carriage 5 stored in the coupled housing 20. The lift mechanism 6 holds the stack tray 51 at an initial position that is close to the stack discharge port 3*c* when the secondary sheet conveyance device 4 starts to convey the sheet 9 to the stack tray 51.

Furthermore, the lift mechanism 6 gradually moves down the stack tray 51 as the number of sheets 9 stacked on the stack tray 51 increases. This maintains a state in which the top upper surface of the sheets 9 on the stack tray 51 is close to the stack discharge port 3*c*.

The CPU 81 includes a plurality of processing modules that are realized when the computer programs are executed. The plurality of processing modules include a main control portion 8*a*, a print control portion 8*b*, and a stack control portion 8*c*.

The main control portion 8*a* executes a start control to start any one of various types of processing in accordance with an operation performed on the main operation device 801, and executes a control of the display device 802.

The print control portion 8*b* executes, for example, a continuous print control. In the continuous print control, the print control portion 8*b* controls the primary sheet conveyance device 12 and the print device 14 so that the print device 14 executes a continuous print process until the number of prints reaches a total output number that is set preliminarily.

In the continuous print process, the print process of a specified image is continuously executed on a plurality of sheets 9. During the continuous print process, the print control portion 8*b* counts the number of prints of the specified image until the number of prints of the specified image reaches the total output number.

The stack control portion 8*c* executes a specified number stack control during the execution of the continuous print control by the print control portion 8*b*. In the specified number stack control, the stack control portion 8*c* stacks a predetermined specified number of sheets 9 on the stack tray 51 of the target unit 2*a* by selecting the target unit 2*a* in sequence from the plurality of coupled units 2 and controlling the secondary sheet conveyance device 4 and the lift mechanism 6 of each of the coupled units 2.

For example, in a case where the total output number of the continuous print process is 2000, and the specified number is 500, the stack control portion 8*c* executes a control to select each of the two coupled units 2 twice in sequence as the target unit 2*a* and stack 500 sheets 9 on the stack tray 51 of the selected target unit 2*a*.

The stack control portion 8*c* counts up the number of sheets 9 with the specified image formed thereon that have been stacked on the stack tray 51 of each of the coupled units 2.

In the specified number stack control, the stack control portion 8*c* maintains the secondary sheet conveyance device 4 of the target unit 2*a* in the stack conveyance state, and maintains the secondary sheet conveyance device 4 of the non-target unit 2*b* that is present upstream of the target unit 2*a* in the main conveyance direction D1, in the relay conveyance state.

Furthermore, the stack control portion 8*c* controls the lift mechanism 6 of the target unit 2*a* to gradually move down the stack tray 51 of the target unit 2*a* from the initial position as the number of sheets 9 stacked on the stack tray 51 increases.

Furthermore, in the specified number stack control, the stack control portion 8*c* stops the secondary sheet conveyance device 4 of the non-target unit 2*b* that is present downstream of the target unit 2*a* in the main conveyance direction D1.

As described above, in the specified number stack control, the stack control portion 8*c* maintains the secondary sheet conveyance device 4 of the target unit 2*a* in the stack conveyance state, and maintains the secondary sheet conveyance device 4 of the non-target unit 2*b* that is present upstream of the target unit 2*a* in the main conveyance direction D1, in the relay conveyance state until a predetermined specified number of sheets 9 are stacked on the stack tray 51 of the target unit 2*a* that is selected from the plurality of coupled units 2.

The sheet stack carriage 5 is moved to a position of a post-process in a state where a large number of sheets 9 are stacked on the stack tray 51. In the post-process, a punching process, a book-binding process or the like is performed on the sheets 9.

Meanwhile, depending on the state of the post-process, the sheet stack carriage 5 may be desired to be moved to the position of the post-process before the number of sheets stacked on the stack tray 51 of the target unit 2*a* reaches the specified number.

In the above-mentioned case, stopping the continuous print process is not favorable since it leads to a decrease in production efficiency.

In the image forming apparatus 100, the stack control portion 8*c* and the print control portion 8*b* execute an interruption stack control that is described below. This allows the image forming apparatus 100 to, without stopping the continuous print process, move the sheet stack carriage 5 while in the middle of stacking the specified number of sheets 9 on the stack tray 51.

In the image forming apparatus 100, each of the coupled units 2 further includes a lock mechanism 7 and a carriage draw-out button 25 (see FIG. 3). When the stack control portion 8*c* causes the lift mechanism 6 to perform a predetermined mount operation, the lock mechanism 7 changes from a lock state to a lock release state in conjunction with the mount operation of the lift mechanism 6, wherein in the lock state, the lock mechanism 7 locks the door 21 to a closed state, and in the lock release state, the lock mechanism 7 releases the lock of the door 21.

Figure 5:
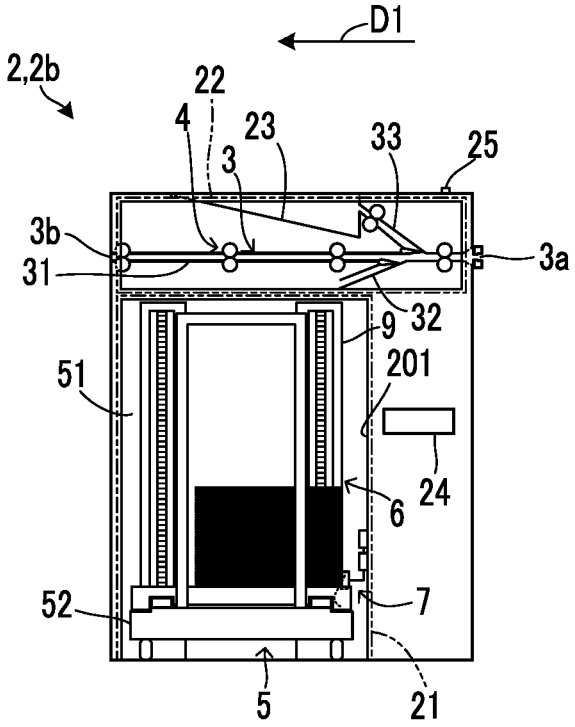
FIG. 5 is a diagram showing the coupled unit in a relay conveyance state in the image forming apparatus according to the embodiment.

By the mount operation of the lift mechanism 6, the stack tray 51 is moved down to a mount position on the carriage portion 52. By the mount operation, the stack tray 51 is mounted on the carriage portion 52. FIG. 5 shows a coupled unit 2 in a state where the stack tray 51 is present at the mount position, and the secondary sheet conveyance device 4 is in the relay conveyance state.

For example, the lock mechanism 7 is changed from one of the lock state and the lock release state to the other by an actuator that operates in accordance with a detection state of a detection sensor that is configured to detect that the lift mechanism 6 has moved down the stack tray 51 to the mount position.

In addition, the lock mechanism 7 may be coupled with a link mechanism that operates in conjunction with the operation of the lift mechanism 6 moving down the stack tray 51 to the mount position, and the lock mechanism 7 may change from one of the lock state and the lock release state to the other in conjunction with the link mechanism.

It is possible to open the door 21 and draw out the sheet stack carriage 5 from the coupled housing 20 only when the lock mechanism 7 is in the lock release state.

The carriage draw-out button 25 is an example of an operation device configured to receive a user operation. The user operates the carriage draw-out button 25 when he/she wants to draw out the sheet stack carriage 5 from the target unit 2*a* in the middle of execution of the specified number stack control.

Interruption Stack Control (Example 1)

Figure 6:
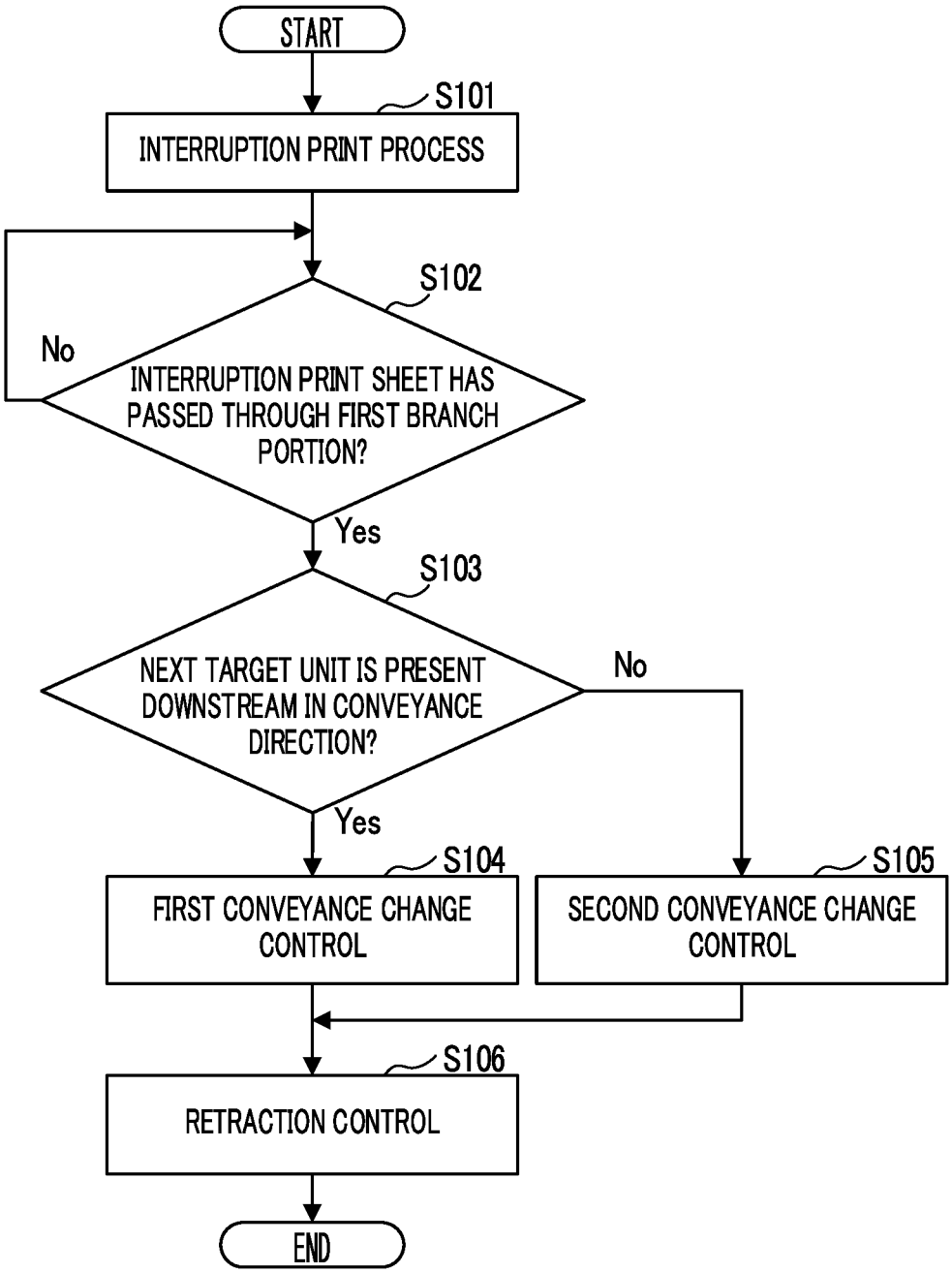
FIG. 6 is a flowchart showing a procedure of Example 1 of an interruption stack control in the image forming apparatus according to the embodiment.

The following describes a procedure of Example 1 of the interruption stack control with reference to the flowchart shown in FIG. 6.

The stack control portion 8*c* starts the interruption stack control when the carriage draw-out button 25 of the target unit 2*a* is operated during execution of the specified number stack control. It is noted that the operation received by the carriage draw-out button 25 of the target unit 2*a* during execution of the specified number stack control is an example of a predetermined interruption operation.

In the following description, S101, S102, . . . are identification signs representing a plurality of steps of the interruption stack control.

<Step S101>

In the interruption stack control, first the print control portion 8*b* causes the print device 14 to execute a predetermined interruption print process, and then moves the process to step S102.

In the interruption print process, a stack number image is formed on the sheet 9, wherein the stack number image indicates the number of sheets 9 stacked on the stack tray 51 of the target unit 2*a*. In the following description, a sheet 9 on which the stack number image has been formed by the interruption print process is referred to as an interruption print sheet.

It is noted that the interruption print sheet is not a sheet 9 on which the specified image has been formed. As a result, the interruption print sheet is removed from the target for counting the number of prints of the specified image and the number of sheets 9 stacked on the stack tray 51.

<Step S102>

In step S102, the stack control portion 8*c* determines whether or not the interruption print sheet has passed through the first branch portion P1 toward the stack conveyance path 32.

For example, the stack control portion 8*c* determines that the interruption print sheet has passed through the first branch portion P1, when a predetermined time period has elapsed since an execution of the interruption print process.

In addition, the secondary sheet conveyance device 4 may be provided with a sheet detection sensor that is disposed in a region extending from the inlet 3*a* to the first branch portion P1 in the relay conveyance path 31. In this case, the stack control portion 8*c* determines whether or not the interruption print sheet has passed through the first branch portion P1 based on a change of a detection signal output from the sheet detection sensor.

Upon determining that the interruption print sheet has passed through the first branch portion P1 toward the stack conveyance path 32, the stack control portion 8*c* moves the process to step S103. In the present embodiment, when the interruption print sheet passes through the first branch portion P1 toward the stack conveyance path 32, it means that the interruption print sheet is conveyed to the stack tray 51 of the target unit 2*a*.

<Step S103>

In step S103, when a coupled unit 2 that is to be selected as the target unit 2*a* next time is downstream of the current target unit 2*a* in the main conveyance direction D1, the stack control portion 8*c* moves the process to step S104. Otherwise, the stack control portion 8*c* moves the process to step S105.

<Step S104>

In step S104, the stack control portion 8*c* executes a first conveyance change control, and then moves the process to step S106.

In the first conveyance change control, the secondary sheet conveyance device 4 of the current target unit 2*a* is changed to the relay conveyance state, and the secondary sheet conveyance device 4 of the coupled unit 2 that is to be selected as the target unit 2*a* next time is changed to the stack conveyance state.

It is noted that, in step S105, the coupled unit 2 that is to be selected as the target unit 2*a* next time is the other coupled unit 2 that is present downstream of the current target unit 2*a* in the main conveyance direction D1.

<Step S105>

In step S105, the stack control portion 8*c* executes a second conveyance change control, and then moves the process to step S106.

In the second conveyance change control, the secondary sheet conveyance device 4 of the coupled unit 2 that is to be selected as the target unit 2*a* next time is changed to the stack conveyance state. In the present embodiment, the second conveyance change control includes a control to stop the secondary sheet conveyance device 4 of the current target unit 2*a*.

It is noted that, in step S106, the coupled unit 2 that is to be selected as the target unit 2*a* next time is the other coupled unit 2 that is present upstream of the current target unit 2*a* in the main conveyance direction D1.

With the execution of the process of step S104 or step S105, the target unit 2*a* is changed in the middle of the specified number stack control, and the specified number stack control for the new target unit 2*a* is restarted.

<Step S106>

In step S106, the stack control portion 8*c* executes a retraction control to cause the lift mechanism 6 of the target unit 2*a* at the time point of start of the control of step S104 or step S105 to execute the mount operation, and then ends the interruption stack control.

The retraction control changes the lock mechanism 7 of the original target unit 2*a* to the lock release state, making it possible to open the door 21 and draw out the sheet stack carriage 5 from the coupled housing 20.

The execution of the interruption stack control shown in FIG. 6 makes it possible to change the target unit 2*a* in the middle of the specified number stack control without stopping the continuous print process.

That is, with the adoption of the image forming apparatus 100, it is possible to, without stopping the continuous print process, move the sheet stack carriage 5 while in the middle of stacking the specified number of sheets 9 on the stack tray 51.

In addition, during the interruption print process executed in step S101, the interruption print sheet is stacked at the top on the stack tray 51 of the sheet stack carriage 5 that has become possible to be drawn out.

Accordingly, the user can easily grasp the number of sheets 9 stacked on the stack tray 51 of the drawn-out sheet stack carriage 5.

Interruption Stack Control (Example 2)

Figure 7:
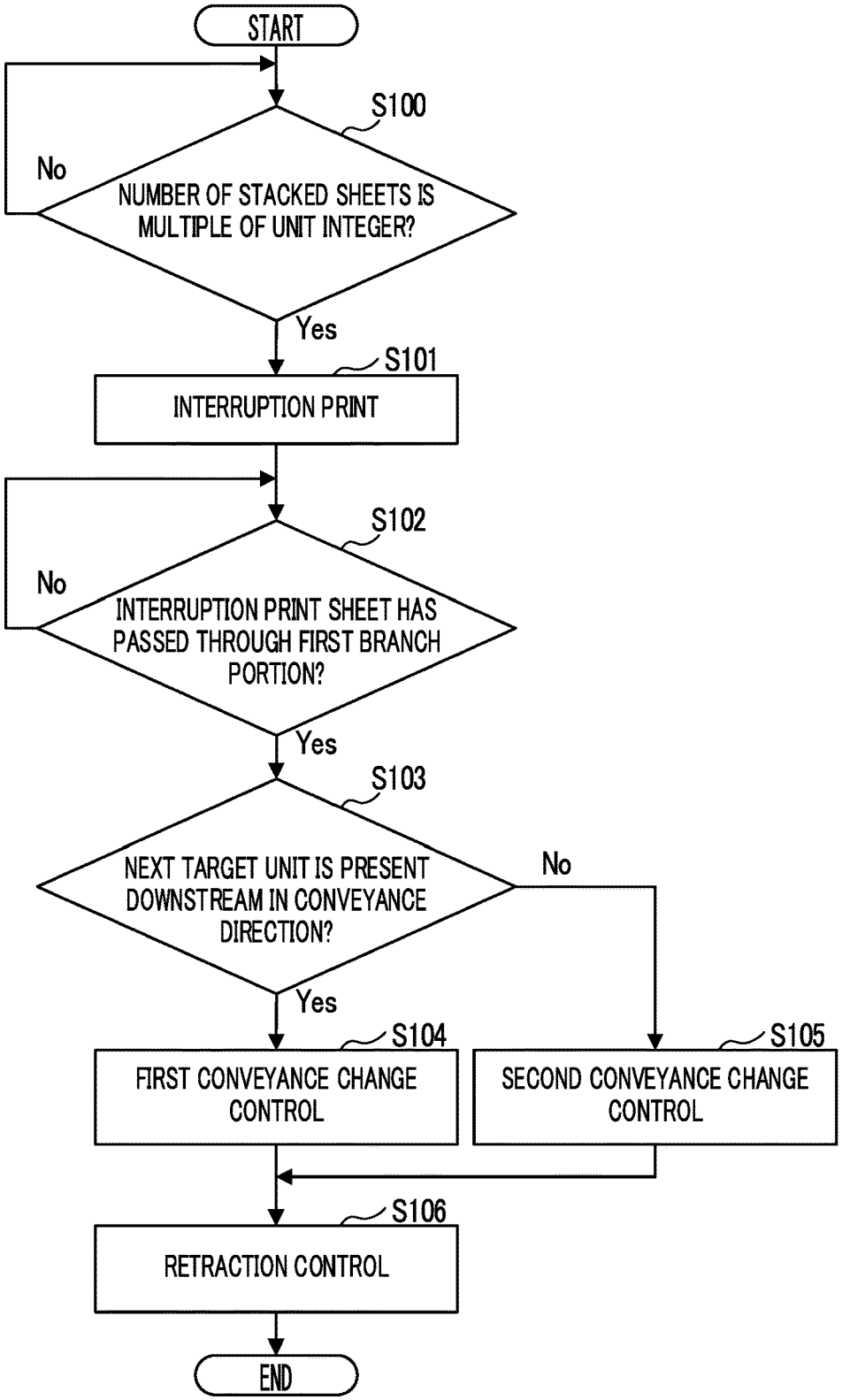
FIG. 7 is a flowchart showing a procedure of Example 2 of the interruption stack control in the image forming apparatus according to the embodiment.

Next, the following describes a procedure of Example 2 of the interruption stack control with reference to the flowchart shown in FIG. 7.

The stack control portion 8*c* starts the interruption stack control shown in FIG. 7 when the carriage draw-out button 25 of the target unit 2*a* is operated during execution of the specified number stack control.

The following describes the difference of Example 2 of the interruption stack control from Example 1 of the interruption stack control.

As shown in FIG. 7, the process of Example 2 of the interruption stack control includes the process of step S100 added in front of the process of step S101 of the interruption stack control shown in FIG. 6.

<Step S100>

In step S100, after the carriage draw-out button 25 receives a user operation, the stack control portion 8*c* waits until a timing when the number of sheets stacked on the stack tray 51 of the target unit 2*a* reaches a multiple of a unit integer that is a predetermined integer. The unit integer is, for example, 5, 10, or 100.

The stack control portion 8*c* moves the process to step S101 at the timing when the number of sheets stacked on the stack tray 51 of the target unit 2*a* reaches a multiple of the unit integer. This allows the print control portion 8*b* to cause the print device 14 to execute the interruption print process (step S101).

It is noted that step S101 and subsequent processes in Example 2 of the interruption stack control are the same as step S101 and subsequent processes in Example 1 of the interruption stack control.

That is, in Example 2 of the interruption stack control, the stack control portion 8*c* executes either the first conveyance change control or the second conveyance change control and the retraction control when the number of sheets 9 stacked on the stack tray 51 of the target unit 2*a* has reached a multiple of the unit integer after the carriage draw-out button 25 received an operation (steps S103 to S106).

With the adoption of Example 2 of the interruption stack control, a similar effect is obtained as in the case where Example 1 of the interruption stack control is adopted. Furthermore, with the adoption of Example 2 of the interruption stack control, the number of sheets 9 stacked on the stack tray 51 when the sheet stack carriage 5 is drawn out is automatically adjusted to a number that can be easily managed by the user.

Application Example

In the image forming apparatus 100, the interruption operation that is a start event of the interruption stack control may be an operation performed on the main operation device 801 of the main body unit 1.

The invention claimed is:

1. An image forming apparatus comprising:

a main body unit that includes a print device configured to execute a print process to form an image on a sheet, the main body unit configured to discharge the sheet with the image formed thereon in a predetermined main conveyance direction;

a plurality of coupled units that are coupled with each other and are coupled with the main body unit at downstream of the main body unit in the main conveyance direction;

a control device configured to control devices that are included in the main body unit and the plurality of coupled units; and an operation device configured to receive a user operation, wherein each of the plurality of coupled units includes:

a housing having a main opening and a door that is configured to open and close the main opening;

a sheet stack carriage including a carriage portion and a stack tray on which sheets can be stacked, the carriage portion configured to be stored into and drawn out from the housing via the main opening;

a lift mechanism configured to move up and down the stack tray of the sheet stack carriage stored in the housing; and a sheet conveyance device configured to change from one of a stack conveyance state and a relay conveyance state to the other, wherein in the stack conveyance state, the sheet conveyance device conveys the sheet discharged from the main body unit or another coupled unit that is coupled therewith at upstream in the main conveyance direction, to a stack conveyance path that is toward onto the stack tray, and in the relay conveyance state, the sheet conveyance device conveys the sheet to a relay conveyance path that is toward another coupled unit that is coupled therewith at downstream in the main conveyance direction, wherein the control device executes a specified number stack control in which the sheet conveyance device of a target unit is held in the stack conveyance state and the sheet conveyance device of another coupled unit that is present upstream of the target unit in the main conveyance direction, is held in the relay conveyance state until a predetermined specified number of sheets are stacked on the stack tray of the target unit that is selected from the plurality of coupled units, the control device further executes an interruption stack control when the operation device receives a predetermined interruption operation during execution of the specified number stack control, the interruption stack control includes: either a first conveyance change control or a second conveyance change control; and a retraction control, wherein in the first conveyance change control, the sheet conveyance device of the target unit is changed to the relay conveyance state, and the sheet conveyance device of another coupled unit that is present downstream of the target unit in the main conveyance direction is changed to the stack conveyance state, in the second conveyance change control, the sheet conveyance device of another coupled unit that is present upstream of the target unit in the main conveyance direction is changed to the stack conveyance state, in the retraction control, the lift mechanism of the target unit is caused to execute a mount operation by which the stack tray is moved down to a mount position on the carriage portion, and in the interruption stack control, the control device causes the print device to execute an interruption print process to form, on a sheet, a number that indicates a number of sheets stacked on the stack tray of the target unit, and executes either the first conveyance change control or the second conveyance change control and the retraction control when the sheet with the number printed thereon has been conveyed to the stack tray of the target unit.

2. The image forming apparatus according to claim 1, wherein in the interruption stack control, the control device causes the print device to execute the interruption print process at a timing when the number of sheets stacked on the stack tray of the target unit reaches an integer multiple of a predetermined number of sheets after the operation device receives the interruption operation.

3. The image forming apparatus according to claim 1, further comprising:

a lock mechanism configured to change from a lock state to a lock release state in conjunction with execution of the mount operation by the lift mechanism, wherein in the lock state, the lock mechanism locks the door to a closed state, and in the lock release state, the lock mechanism releases a lock of the door.

4. An image forming apparatus comprising:

a main body unit that includes a print device configured to execute a print process to form an image on a sheet, the main body unit configured to discharge the sheet with the image formed thereon in a predetermined main conveyance direction;

a plurality of coupled units that are coupled with each other and are coupled with the main body unit at downstream of the main body unit in the main conveyance direction;

a control device configured to control devices that are included in the main body unit and the plurality of coupled units; and an operation device configured to receive a user operation, wherein each of the plurality of coupled units includes:

a housing having a main opening and a door that is configured to open and close the main opening;

a sheet stack carriage including a carriage portion and a stack tray on which sheets can be stacked, the carriage portion configured to be stored into and drawn out from the housing via the main opening;

a lift mechanism configured to move up and down the stack tray of the sheet stack carriage stored in the housing; and a sheet conveyance device configured to change from one of a stack conveyance state and a relay conveyance state to the other, wherein in the stack conveyance state, the sheet conveyance device conveys the sheet discharged from the main body unit or another coupled unit that is coupled therewith at upstream in the main conveyance direction, to a stack conveyance path that is toward onto the stack tray, and in the relay conveyance state, the sheet conveyance device conveys the sheet to a relay conveyance path that is toward another coupled unit that is coupled therewith at downstream in the main conveyance direction, wherein the control device executes a specified number stack control in which the sheet conveyance device of a target unit is held in the stack conveyance state and the sheet conveyance device of another coupled unit that is present upstream of the target unit in the main conveyance direction, is held in the relay conveyance state until a predetermined specified number of sheets are stacked on the stack tray of the target unit that is selected from the plurality of coupled units, the control device further executes an interruption stack control when the operation device receives a predetermined interruption operation during execution of the specified number stack control, the interruption stack control includes: either a first conveyance change control or a second conveyance change control; and a retraction control, wherein in the first conveyance change control, the sheet conveyance device of the target unit is changed to the relay conveyance state, and the sheet conveyance device of another coupled unit that is present downstream of the target unit in the main conveyance direction is changed to the stack conveyance state, in the second conveyance change control, the sheet conveyance device of another coupled unit that is present upstream of the target unit in the main conveyance direction is changed to the stack conveyance state, in the retraction control, the lift mechanism of the target unit is caused to execute a mount operation by which the stack tray is moved down to a mount position on the carriage portion, and in the interruption stack control, the control device executes either the first conveyance change control or the second conveyance change control and the retraction control when a number of sheets stacked on the stack tray of the target unit has reached an integer multiple of a predetermined number of sheets after the operation device received the interruption operation.

5. The image forming apparatus according to claim 4, further comprising:

a lock mechanism configured to change from a lock state to a lock release state in conjunction with execution of the mount operation by the lift mechanism, wherein in the lock state, the lock mechanism locks the door to a closed state, and in the lock release state, the lock mechanism releases a lock of the door.

* * * * *